US010455926B2

(12) United States Patent
Valpey

(10) Patent No.: US 10,455,926 B2
(45) Date of Patent: Oct. 29, 2019

(54) CARRYING CASE, CARRYING CASE KIT AND METHODS

(71) Applicant: Edward Valpey, Gilford, NH (US)

(72) Inventor: Edward Valpey, Gilford, NH (US)

( * ) Notice: Subject to any disclaimer, the term of this patent is extended or adjusted under 35 U.S.C. 154(b) by 0 days.

(21) Appl. No.: 15/946,399

(22) Filed: Apr. 5, 2018

(65) Prior Publication Data

US 2018/0289139 A1 Oct. 11, 2018

Related U.S. Application Data

(60) Provisional application No. 62/482,647, filed on Apr. 6, 2017.

(51) Int. Cl.
*A45F 5/02* (2006.01)

(52) U.S. Cl.
CPC ..... *A45F 5/021* (2013.01); *A45F 2200/05* (2013.01); *A45F 2200/0516* (2013.01); *A45F 2200/0566* (2013.01); *A45F 2200/0575* (2013.01); *A45F 2200/0591* (2013.01)

(58) Field of Classification Search
CPC .... A45F 5/021; A45F 5/00; A45F 5/02; A45F 2200/0516; A45F 2200/0575; A45C 2011/002; Y10S 224/93
USPC ..... 224/250
See application file for complete search history.

(56) References Cited

U.S. PATENT DOCUMENTS

| | | | | |
|---|---|---|---|---|
| 5,535,928 | A * | 7/1996 | Herring | A45F 5/02 224/250 |
| 5,806,730 | A * | 9/1998 | Deno | A45F 5/02 224/148.6 |
| 6,412,674 | B1 * | 7/2002 | Lipke | A45C 7/00 224/235 |
| 9,392,863 | B2 * | 7/2016 | Hamilton | A45F 5/021 |
| 2007/0205244 | A1 * | 9/2007 | Hewes, Jr. | A45F 5/02 224/674 |
| 2009/0127304 | A1 * | 5/2009 | Uygur | A45F 5/02 224/250 |
| 2013/0119098 | A1 * | 5/2013 | Stiefel | A45F 5/02 224/183 |

* cited by examiner

*Primary Examiner* — Adam J Waggenspack
(74) *Attorney, Agent, or Firm* — Michael Persson; Catherine Napjuo; Christian Persson & Ball P.C.

(57) ABSTRACT

A carrying case that is adaptable to carry a variety of devices of different sizes and to attach to a variety of things. The carrying case includes a main panel and a tail strap, each manufactured from a substantially thin flexible material. Hook portion and loop portions are provided at predetermined locations on the top and bottom surfaces of the main panel and tail strap and the folding of the main panel and tail strap and securing of hook portions to loop portions forms the carrying case around a device to be carried.

19 Claims, 15 Drawing Sheets

CARRYING CASE, CARRYING CASE KIT AND METHODS

CLAIM OF PRIORITY

This application is a non-provisional application claiming the benefit of priority of U.S. Provisional Patent Application Ser. No. 62/482,647 filed on Apr. 6, 2017.

FIELD OF THE INVENTION

The present invention relates to the field of device carrying cases and, in particular, to carrying cases that are adaptable for carrying a variety of devices and attachment to a variety of items.

BACKGROUND OF THE INVENTION

Cases have long been used to hold devices and attach them people and things. Prior to the prevalence of cellular telephones, cases were commonly used to hold devices such as knives, flashlights, multi-tools and the like. Such cases typically take the form of a leather pouch having a main body with a storage compartment sized and shaped specifically for the device to be held and had a permanent fixed sized belt loop attached to the outside of the main body that allowed a user to attach the case to a person's belt. Some such cases often also include a top flap that folds over the open top of the storage compartment and is secured once the device is placed in the case in order to prevent the device from accidentally falling out of the case.

Traditional cases work well when they were only used to carry a specific device and to only attach the device to a person's belt. However, they are not useful for carrying different devices, which means that different cases are needed for each different device. Further, these cases are only adaptable for attachment to a belt and cannot be easily attached to a backpack, purse, tool pouch, or another device, such as a bicycle. In addition, they were not adapted to be attached in any position other than perpendicular to the user's belt.

The advent of the prevalence of cellular telephones in recent years has spurred advancements in the art of carrying cases. Some cellular phone cases take the form of the traditional cases described above. However, others are adapted to hold phones of different sizes and many include rotatable clips that allow them to be attached to items other than belts. Unfortunately, the size variability is generally limited to variability of a single dimension, typically width. Further, the variability results in unwanted bulkiness and generally results in the outside of the phone being unprotected and increases the chance that the phone will unintentionally dislodge from the case. Finally, although these cases may be attached to more items than belts, their applicability is still substantially limited and the cases are relatively expensive.

Therefore, there is a need for a carrying case that is adapted to carry devices of different sizes and whose variability is not limited to a single dimension, that is easily adapted for attachment to a variety of items, that allows a user to position the case in a variety of positions without substantial risk of the device being unintentionally dislodged, that is not overly bulky, that protects substantially all surfaces of the device, and that is relatively inexpensive.

SUMMARY OF THE INVENTION

The present invention is a low cost, lightweight, carrying case that is adaptable to carry a variety of devices of different sizes and to attach to a variety of things. In its most basic form, the carrying case includes a main panel and a tail strap, each manufactured from a substantially thin flexible material.

The main panel includes a top surface, a bottom surface, substantially rectangular device wrap portion and a main strap portion extending from the device wrap portion. The device wrap portion has a width and a length. The width of the device wrap portion is sized to wrap around the width of a preferred device and the length of the device wrap portion is adapted to cover at least a substantial portion of the length of a preferred device.

The main strap portion has a width that is a fraction of the width of the device wrap portion. The main strap portion extends from the device wrap portion and is positioned such that the midpoint of the width of the main strap portion is substantially coincident with the midpoint of the width of the device wrap portion. The main strap has a main strap length, defined as the distance between the device wrap portion and main strap end, which is at least one and a half times the length of the preferred device.

The tail strap is attached to the bottom surface of the main strap portion of the main panel at a location along the main strap length that is proximate to the length of the preferred device. The tail strap has a width that is preferably slightly smaller than the width of the main strap portion and a tail strap length, defined as the distance between the connection end and the tail strap free end, which is between one and a half and two and a half times the length of the preferred device. The tail strap also has a tail strap top surface and a tail strap bottom surface.

Hook portions and loop portions of hook and loop fasteners are attached at specific locations on to the main panel top surface, main panel bottom surface, tail strap top surface and tail strap bottom surface. First hook portion and second hook portion are disposed upon the bottom surface of the device wrap portion at opposite ends along its width and preferably extend substantially along the entire length of the bottom surface of the device wrap portion. Third hook portion is disposed upon the bottom surface of the main strap portion of the main strap proximate to the main strap end. Fourth hook portion is disposed along substantially the entire length and width of the top surface of the tail strap. First loop portion is disposed upon the top surface of the device wrap portion at one end along its width and preferably extends substantially along the entire length of the top surface of the device wrap portion. Second loop portion is disposed upon the top surface of the main panel top surface proximate to the midpoint of the device wrap portion and extends along substantially the entire length of the top surface of the device wrap portion and along the main strap to the approximate point of connection between the main strap and the tail strap. Third loop portion is disposed along substantially the entire length and width of the bottom surface of the tail strap.

The preferred carrying case includes a main panel having folded edges that prevent fraying of the thin flexible material during use. In such embodiments, the main panel has a lengthened device wrap portion and a widened main strap portion. The device wrap portion is then folded over its length and held in place by magnets or other temporary fasteners. The widened areas of the main strap are folded over and are also held in place by magnets or other temporary fasteners. The device wrap portion and the main strap are then stitched together. The result is a main panel that is the same dimensions as in other embodiments, except for the fact that the edges are folded and not prone to fraying. As the main panel is the same dimensionally, all steps of the methods described above may be performed in substantially the same manner.

The preferred carrying case also includes a retaining loop portion on the bottom portion of the device wrap portion in the location opposite the first loop portion, where no hook or loop portions are located in the basic embodiment. The addition of the retaining loop portion prevents the case from riding up when a device is removed from the case when mounted in a vertical position on a user's belt.

The steps of the preferred method of securing the carrying case to a device such that a belt loop is formed begins with the main panel laid flat with its top surface facing upward. First, a device is placed upon the top surface of the main strap proximate to the device wrap portion. Second, the device wrap portion is then folded upward such the top surface of the device wrap portion is in contact with the top portion of the device and the portion of the main strap proximate to the device wrap portion is in contact with the lower end of the device. Third, the main strap end of the main strap is then folded downward over the upper end of the device and third hook portion is secured to second loop portion. Fourth, the portion of the device wrap portion extending from the right side of the device is then folded around the right side of the device and first hook portion is secured to the portion of second loop portion proximate to the bottom surface of the device such that first loop portion is exposed. Fifth, the portion of the device wrap portion extending from the left side of the device is then folded around the left side of the device and second hook portion is secured to first loop portion. Sixth, the tail strap is then folded around the lower end of the device, leaving a portion of fourth hook portion exposed. Seventh, main strap is then pulled upward such that third hook portion releases from second loop portion and tail strap is wrapped upward such that fourth hook portion is secured to second loop portion and such that third loop portion is exposed. Eighth, main strap is then folded back downward over the upper portion of the device and third hook portion is secured to third loop portion. When assembled in this manner, a belt loop is formed by the belt loop gap between the tail strap and the device wrap portions secured proximate to the bottom surface of the device and the main strap forms a cover that allows the device to be secured within the carrying case.

In another embodiment of the method, the carrying case is attached to a belt, or other thing, not by the belt loop but, rather, by folding and securing device wrap portion around the belt. This method includes all of the steps of the preferred method but includes the additional steps of unsecuring the second hook portion from the first loop portion, unsecuring the first hook portion from the second loop portion, wrapping the portion of the device wrap portion extending from the right side of the device around the belt and securing the first hook portion to the portion of second loop portion proximate to the bottom surface of the device, and wrapping the portion of the device wrap portion extending from the left side of the device around the belt and securing the second hook portion to first loop portion.

In still another embodiment of the method, the tail strap is used to form a larger loop that may be used to hang the case and device from a thing, such as a bicycle handlebar, backpack D-ring, tent cross beam or the like. The steps of the method of securing the carrying case to a device such that a large loop is formed also begins with the main panel laid flat with its top surface facing upward. First, a device is placed upon the top surface of the main strap proximate to the device wrap portion. Second, the device wrap portion is then folded upward such the top surface of the device wrap portion is in contact with the top portion of the device and the portion of the main strap proximate to the device wrap portion is in contact with the lower end of the device. Third, the main strap end of the main strap is then folded downward over the upper end of the device and third hook portion is secured to second loop portion. Fourth, the tail strap is then folded in an opposite direction from the main strap end 28 and the fourth hook portion is secured to the second loop portion such that the tail strap forms a loop of a desired size. Fifth, the portion of the device wrap portion extending from the right side of the device is then folded around the right side of the device and first hook portion is secured to the third loop. Sixth, the portion of the device wrap portion extending from the left side of the device is then folded around the left side of the device and second hook portion is secured to first loop portion. When assembled in this manner, a loop is formed by the tail strap and the main strap forms a cover that allows the device to be secured within the carrying case.

The kit of the present invention includes the carrying case and at least one connector, such as a quick link chain connector, a carabineer, D-ring, or the like. In these embodiments, the connector includes an opening that is sized to allow the tail strap to pass therethrough. In some embodiments of the kit, two or more of the same type of connector are provided. In still others, at least one of a variety of types of connectors are provided.

Therefore, it is an aspect of the invention to provide a carrying case that is adapted to carry devices of different sizes and whose variability is not limited to a single dimension.

It is a further aspect of the invention to provide a carrying case that is easily adapted for attachment to a variety of items.

It is a further aspect of the invention to provide a carrying case that allows a user to position the case in a variety of positions without substantial risk of the device being unintentionally dislodged.

It is a further aspect of the invention to provide a carrying case that is not overly bulky, that protects substantially all surfaces of the device.

It is a still further aspect of the invention to provide a carrying case that is relatively inexpensive.

These aspects of the present invention are not meant to be exclusive and other features, aspects, and advantages of the present invention will be readily apparent to those of ordinary skill in the art when read in conjunction with the description and accompanying drawings.

DETAILED DESCRIPTION OF THE INVENTION

Figure 1A:
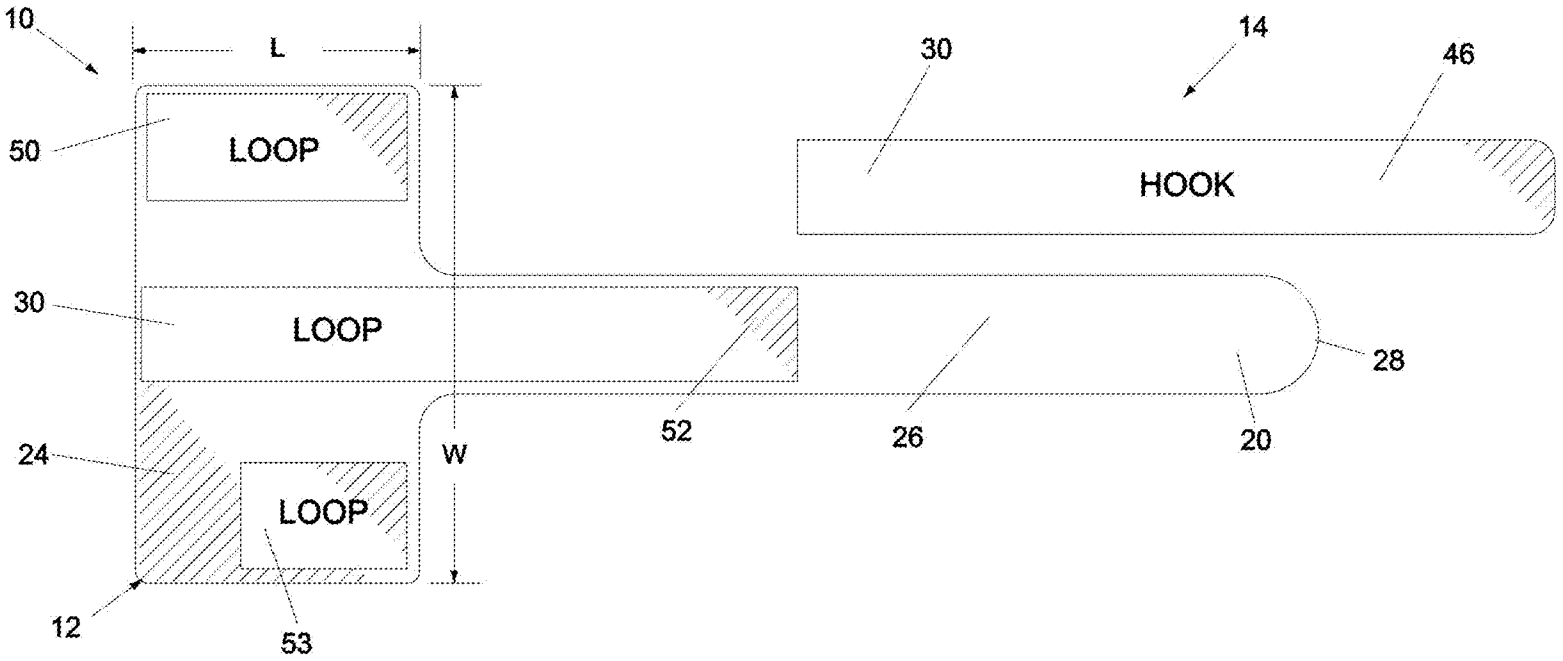
FIG. 1A is a top assembly view of the main panel and tail strap that are joined together to form the carrying case of the present invention.
Figure 1B:
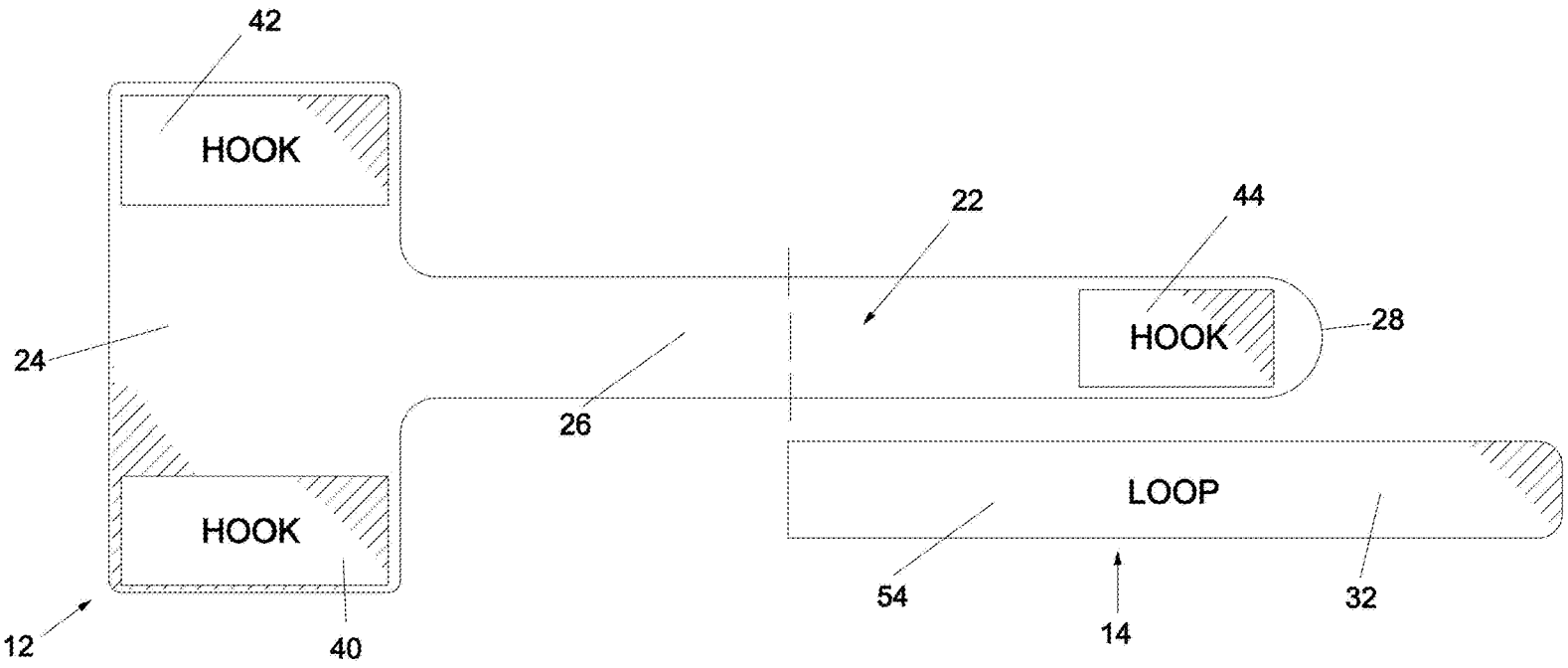
FIG. 1B is a bottom assembly view of the main panel and tail strap that are joined together to form the carrying case of the present invention.

Referring first to FIGS. 1A and 1B, the present invention is a low cost, lightweight, carrying case 10 that is adaptable to carry a variety of devices of different sizes and to attach to a variety of things. In its most basic form, the carrying case 10 includes a main panel 12 and a tail strap 14, each manufactured from a substantially thin flexible material. The preferred material for use in embodiments with folded edges is a 1000 denier nylon material having a thickness of 0.020 inches of a type sold under the trademark "CORDURA". However, a 1500 denier nylon material may be substituted. A 1050 denier ballistic nylon material having a thickness of 0.040 inches may also be used in embodiments without folded edges but is not preferred due to potential issues with fraying of the unfolded edges. Other suitable materials will be readily evident to those of skill in the art and the invention should not be seen as limited to the materials described herein.

The main panel 12 includes a main panel top surface 20, a main panel bottom surface 22, a substantially rectangular device wrap portion 24 and a main strap portion 26 extending from the device wrap portion 24. The device wrap portion 24 has a width W and a length L. The width W of the device wrap portion 24 is sized to wrap around the width of a preferred device and the length L of the device wrap portion 24 is adapted to cover at least a substantial portion of the length of a preferred device 100. In embodiments of the invention adapted for use with a multi-tool device, the width W is preferably between five inches and six inches and the length is between two and one half inches and three and one half inches. In embodiments of the invention adapted for use with a cellular phone device, the width W is preferably between ten inches and twelve inches and the length is between four inches and six inches.

The main strap portion 26 has a width that is a fraction of the width of the device wrap portion 24 and, in the preferred embodiment, is between three quarters of one inch and one and one half inches. The main strap portion 26 extends from the device wrap portion 24 and is positioned such that the midpoint 30 of the width of the main strap portion 26 is substantially coincident with the midpoint 30 of the width W of the device wrap portion 24. The main strap has a main strap length, defined as the distance between the device wrap portion 24 and main strap end 28, which is at least one and a half times the length of the device to be carried. In the preferred embodiment, the length of the main strap is between eight inches and fourteen inches.

The tail strap 14 is attached to the main panel top surface 20 along the main strap portion 26 of the main panel 12 at a location that is proximate to the length of the device 100 to be carried. In the preferred embodiment, the tail strap 14 is attached at a location along the length of said main strap portion 26 a distance of between four inches and six and one half inches. The tail strap 14 has a width that is preferably slightly smaller than the width of the main strap portion 26 and a tail strap length, defined as the distance between the tail strap connection end 36 and the tail strap free end 38, that is between one and a half and two and a half times the length of the preferred device 100. In the preferred embodiment, the tail strap length is between eighth inches and fourteen inches. The tail strap 14 has a tail strap top surface 30 and a tail strap bottom surface 32 and is attached to the to the main panel top surface 20 along the main strap portion 26 of the main panel 12 such that the tail strap top surface 30 is exposed when the main panel top surface 20 is exposed.

Hook portions and loop portions of hook and loop fasteners are attached at specific locations on to the main panel top surface 20, main panel bottom surface 22, tail strap top surface 30 and tail strap bottom surface 32.

As shown in FIG. 1B, first hook portion 40 and second hook portion 42 are disposed upon the main panel bottom surface 22 of the device wrap portion 24 at opposite ends along its width and preferably extend substantially along the entire length of the main panel bottom surface 22 of the device wrap portion 24. Third hook portion 44 is disposed upon a portion of the main panel bottom surface 22 of the main strap portion 27 proximate to the main strap end 28. Third loop portion 54 is disposed along substantially the entire length and width of the tail strop bottom surface 32 of the tail strap 14.

As shown in FIG. 1A, fourth hook portion 46 is disposed along substantially the entire length and width of the tail strap top surface 30 of the tail strap 14. First loop portion 50 is disposed upon the main panel top surface 20 of the device wrap portion 24 at one end along its width and preferably extends substantially along the entire length of the main panel top surface 20 of the device wrap portion 24. Second loop portion 52 is disposed upon the main panel top surface 20 of the main panel proximate to the midpoint 30 of the device wrap portion 24 and extends along substantially the entire length of the main panel top surface 20 of the device wrap portion 24 and along the main strap portion 26 to the approximate point of connection between the main strap and the tail strap 14. Finally, in the embodiment of FIG. 1A, retaining loop portion 53 is disposed on the main panel top surface 20 portion of the device wrap portion 24 in the location opposite second loop portion 52. The retaining loop portion 53 is optional and acts to prevent the carrying case 10 from riding up when a device is removed from the carrying case 10 when mounted in a vertical position on a user's belt. However, in embodiments such as the embodiment of FIG. 2B, the retaining loop portion 52 is omitted.

First hook portion 40, second hook portion 42, and first loop portion 50 are preferably each the same size and have a width of between three quarters of an inch and two inches. Third hook portion 44, fourth hook portion 46, second loop portion 52 and third loop portion 54 are also preferably each the same width and have a width of between three quarters of an inch and one and one quarter inches.

Figure 2A:
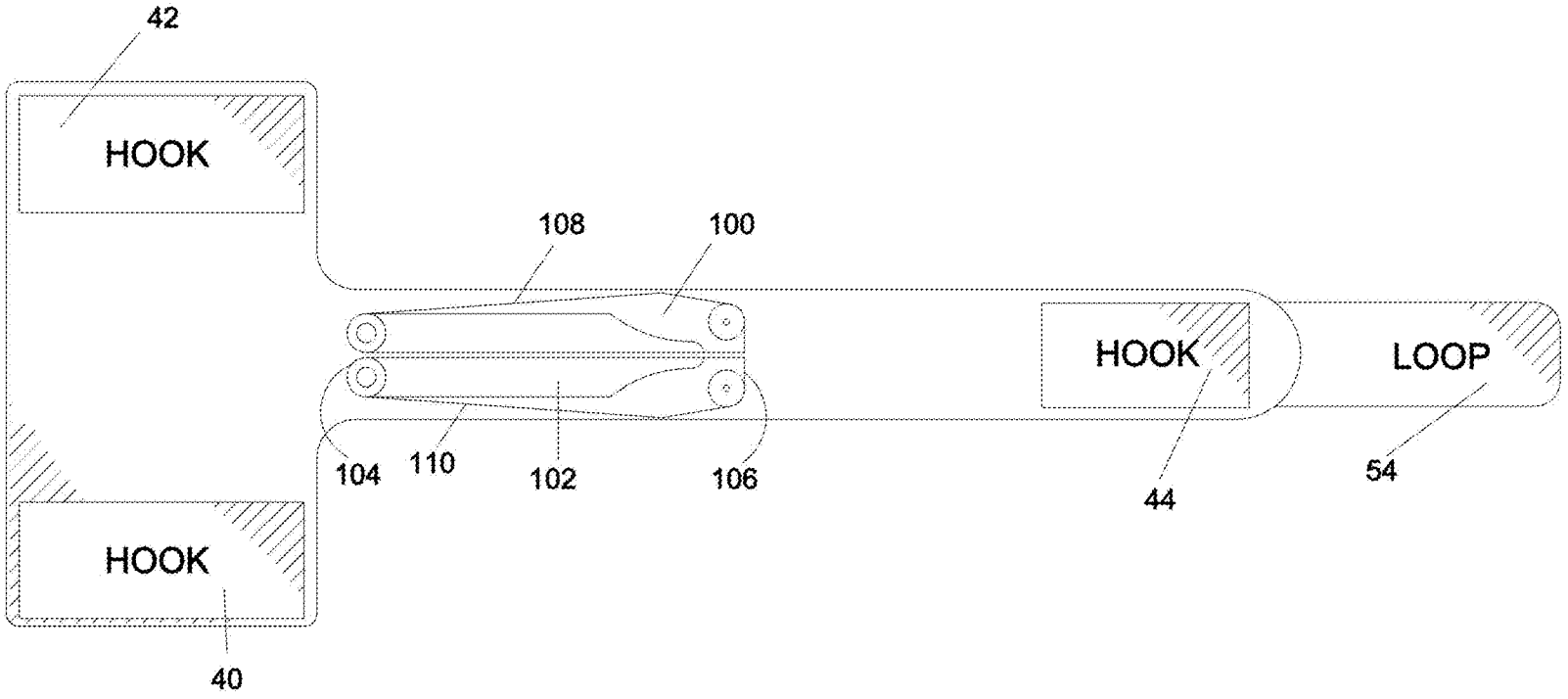
FIG. 2A is a bottom view of the carrying case in an initial configuration with a multi-tool device disposed in position to be secured within the carrying case.
Figure 2B:
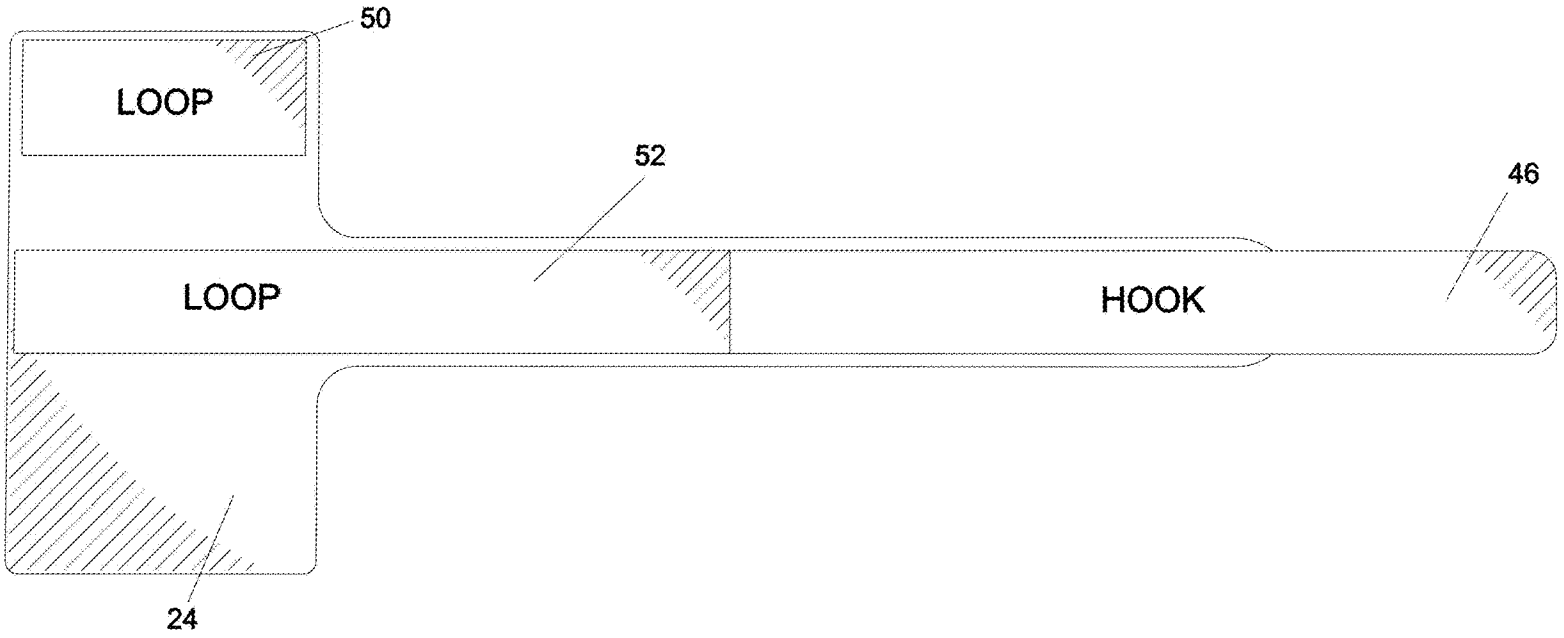
FIG. 2B is a top view of one embodiment of the carrying case in an initial configuration with a multi-tool device disposed in position to be secured within the carrying case.
Figure 3A:
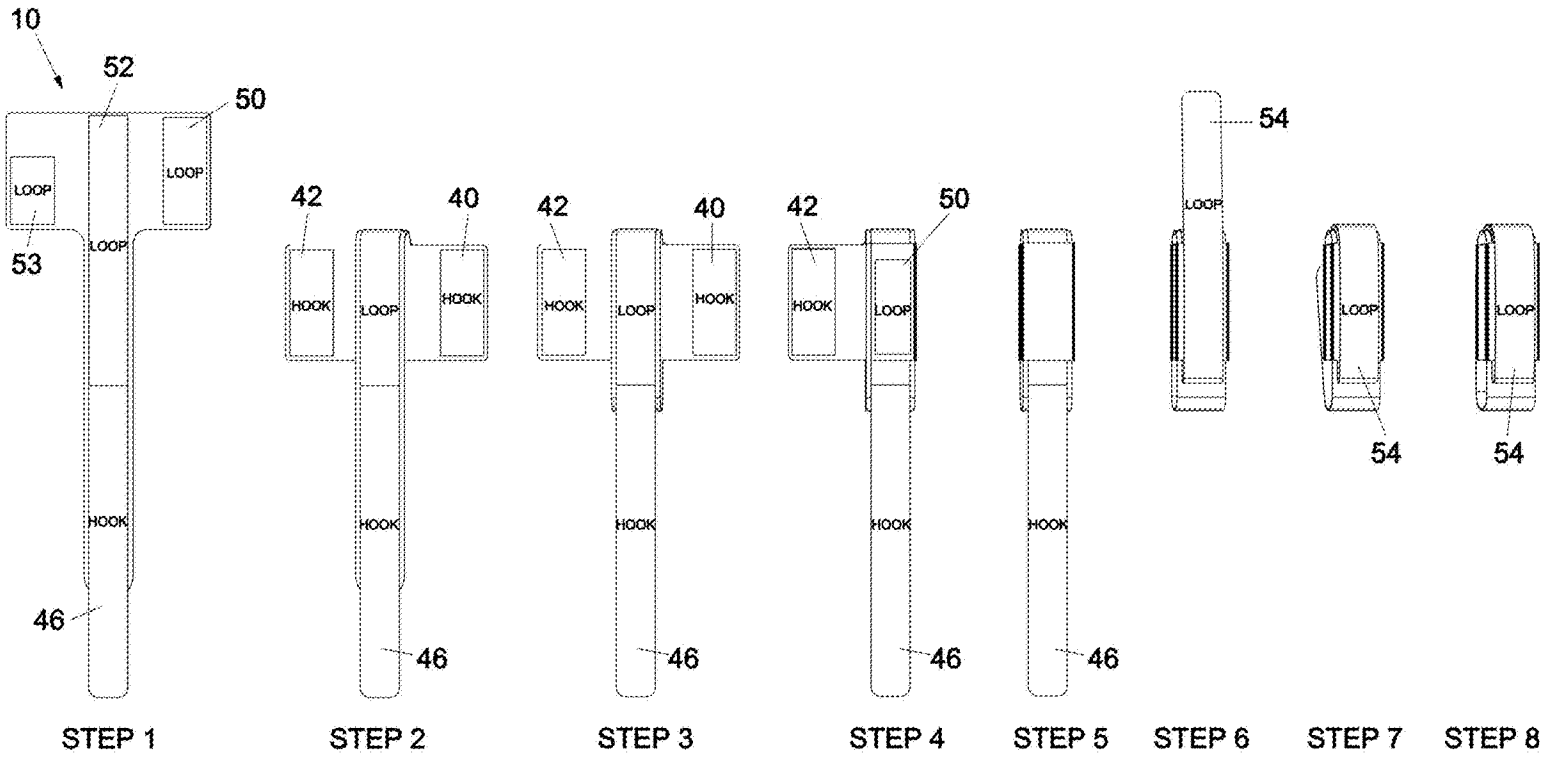
FIG. 3A is a series of top views of the carrying case demonstrating the steps of the preferred method of securing a multi-tool device within the carrying case in which the case forms a belt loop.
Figure 3B:
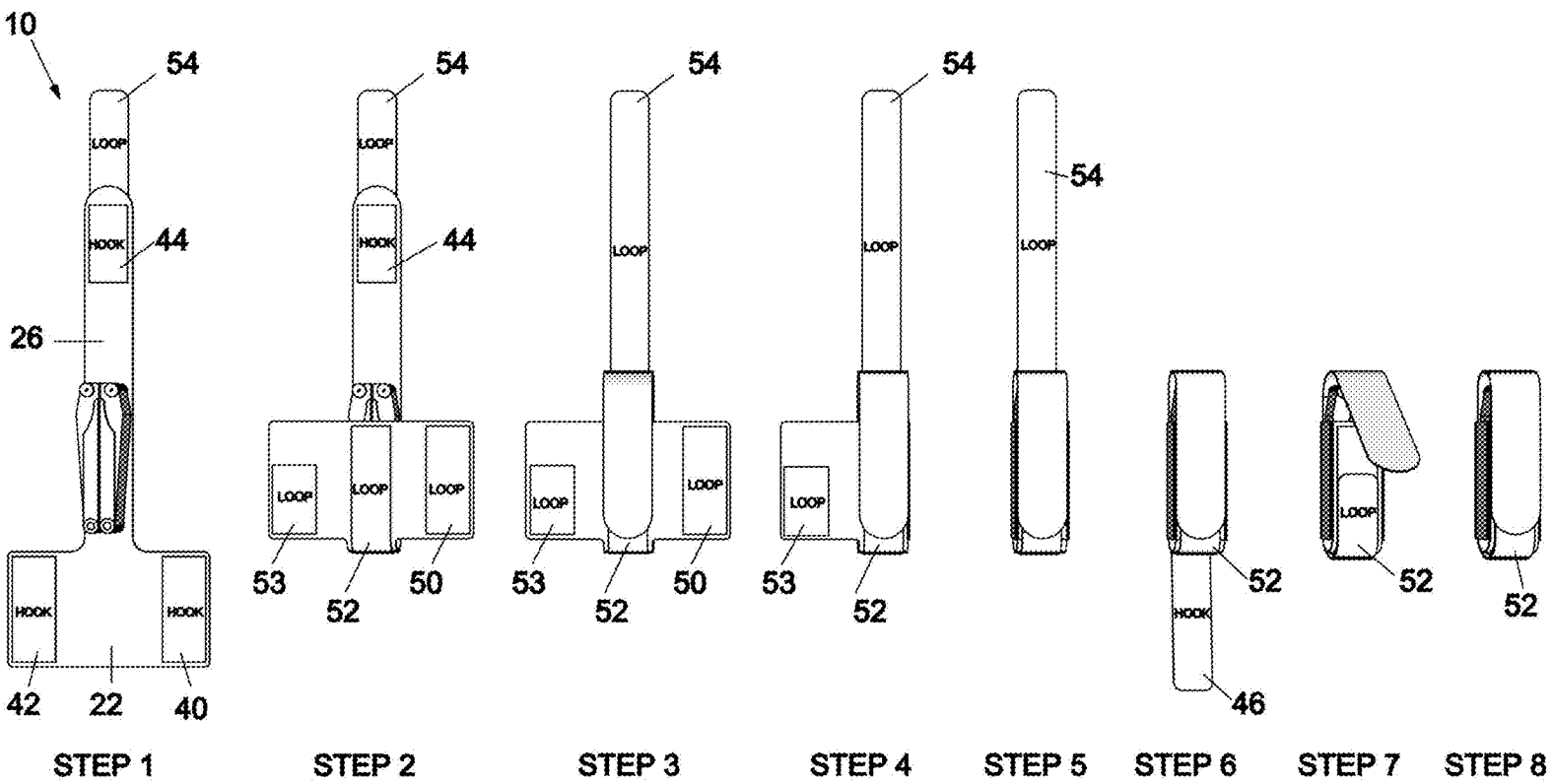
FIG. 3B is a series of bottom views of the carrying case demonstrating the steps of the preferred method of securing a multi-tool device within the carrying case in which the case forms a belt loop.

Referring now to FIGS. 2A and 2B, some embodiments of the carrying case 10 are dimensioned to carry a multi-tool device 100 having a device lower end 104, a device upper end 106, a device top surface 102, a device left side 108 and a device right side 110. As shown in FIG. 2A, the assembly of the carrying case 10 begins by orienting the carrying case 10 such that the main panel bottom surface 22 is exposed and placing device 100 upon the main panel bottom surface 22 of the main strap portion 26 at a location such that the distance between the device lower end 104 and the device wrap portion 24 of the main panel 12 is approximately equal to the thickness of the device 100. As shown in FIGS. 3A and 3B, the folding of the main panel 12 around the device 100 causes the device wrap portion 24 of the main panel 12 to surround the device 100 and, therefore, bottom surface 22 of the main panel forms the inner surface of the carrying case 10 once assembled.

Figure 7A:
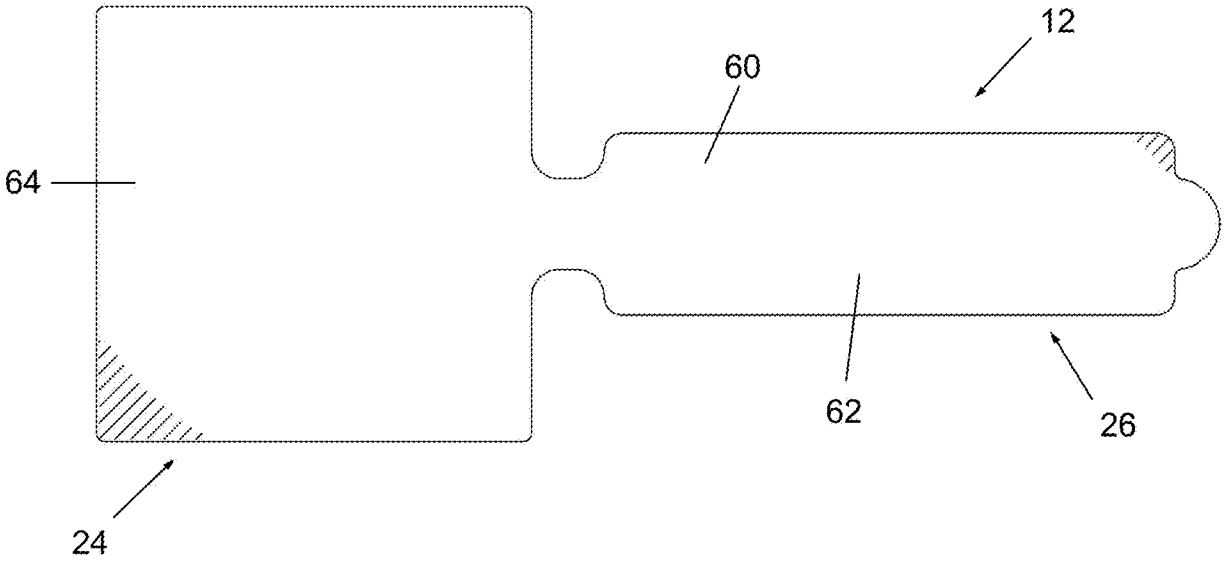
FIG. 7A is a bottom assembly view of the preferred main panel, which includes widened portions.

The preferred carrying case 10 includes a main panel 12 having folded edges that prevent fraying of the thin flexible material during use. In such embodiments, the main panel 12 is formed from a sheet of material as shown in FIG. 7A, which has a lengthened device wrap portion 64, a first widened main strap portion 60 and a second widened main strap portion 62. The device wrap portion 64 is then folded over its length and held in place by magnets 80 or other temporary fasteners. The first widened main strap portion 60 and second widened main strap portion 62 are folded over and are also held in place by magnets 80 or other temporary fasteners. The device wrap portion 24 and the main strap portion 26 are then stitched or otherwise joined together. The result is a main panel 12 that is the same dimensions as in other embodiments, except for the fact that the edges are folded and not prone to fraying.

Figure 7B:
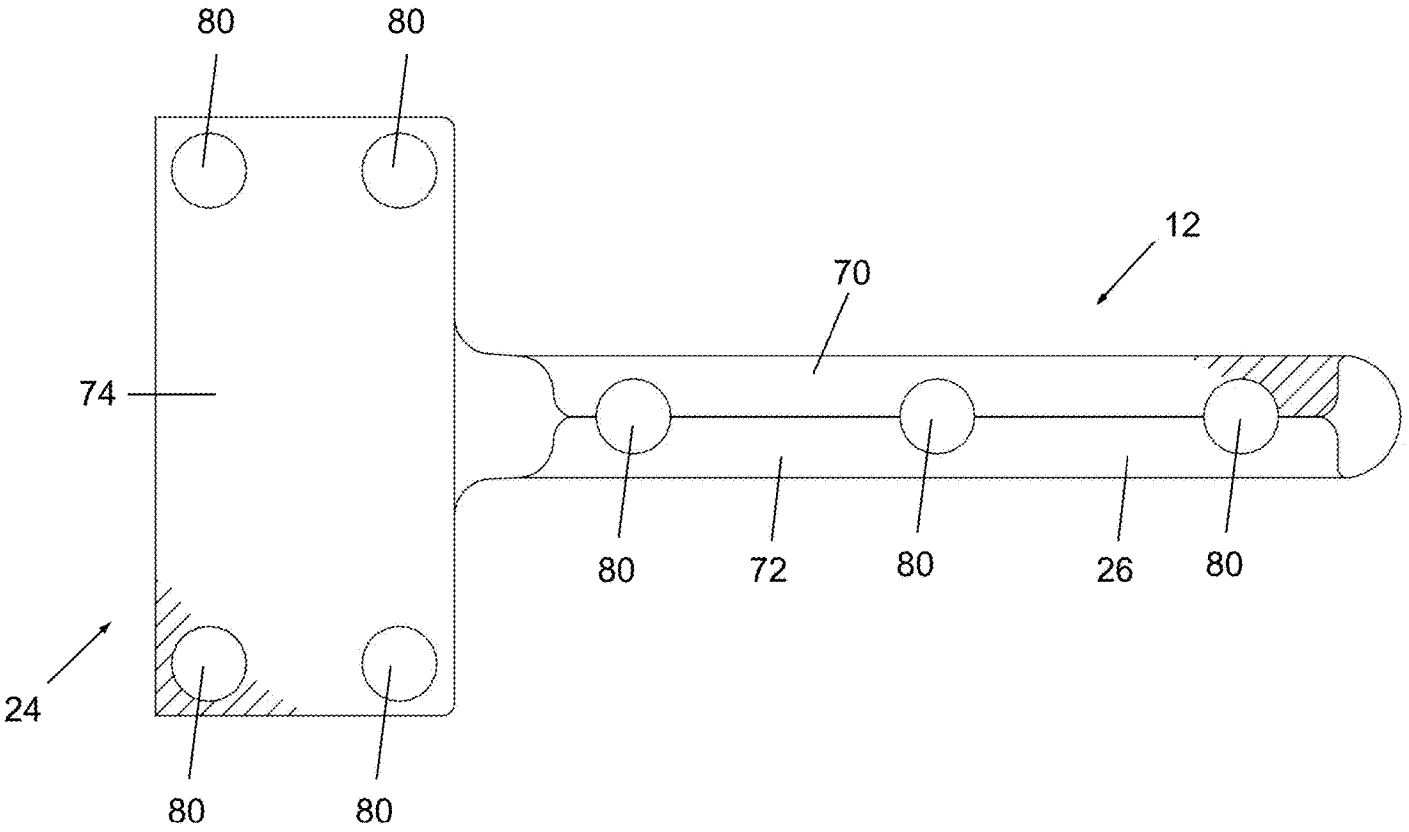
FIG. 7B is a bottom assembly view of the preferred main panel with the widened portions folded over and held in place for stitching by magnets.
Figure 8:
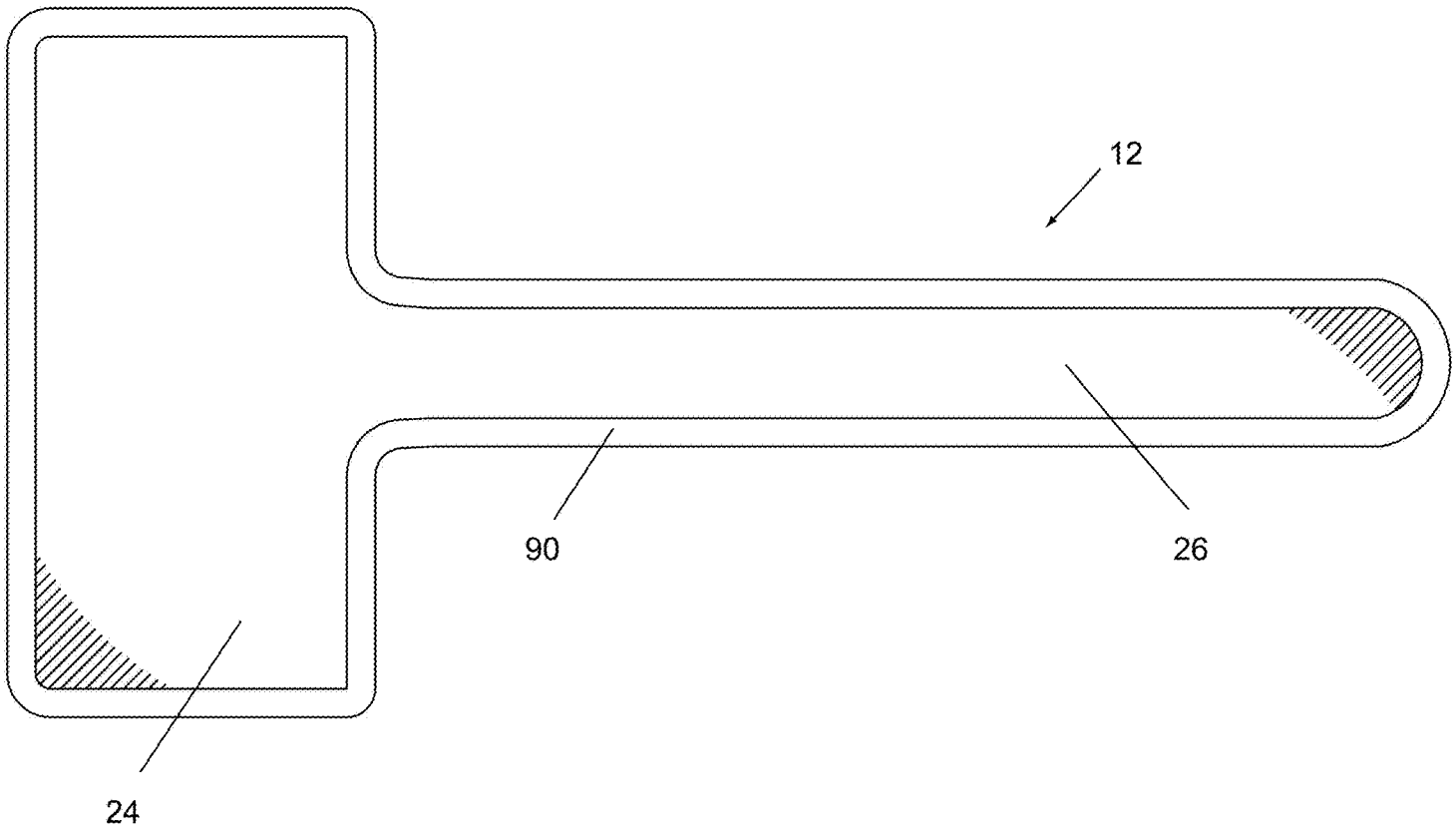
FIG. 8 is a bottom assembly view of an alternative embodiment of the main panel with bound edges.

As shown in FIG. 8, in some embodiments of the carrying case 10, the main panel 12 has bound edges 90. Bound edges 90 are formed by wrapping an edge material, such as thin nylon, about the perimeter of the main panel 12 and securing the material to the main panel 12 by stitching, gluing or other joining methods commonly used in the art. The use of bound edges 90 prevents fraying of the thin flexible material during use in manner similar to use of folded edges described with reference to FIGS. 7A and 7B.

Referring first to FIGS. 3A and 3B, the steps of the preferred method of securing the carrying case 10 to a device 100 such that a belt loop are shown with FIG. 3A showing the assembly from the perspective of the main panel top surface 20 and FIG. 3B showing the assembly from the perspective of the main panel bottom surface 22.

The method begins with the main panel 12 laid flat with its bottom surface 22 facing upward. In Step 1, a device 100, in this case a multi-tool device, is placed upon the main panel bottom surface 22 of the main strap portion 26 proximate to the device wrap portion 24. In Step 2, the device wrap portion 24 is folded upward such the main panel bottom surface 22 of the device wrap portion 24 is in contact with the device 100 and the portion of the main strap proximate to the device wrap portion 24 is in contact with the lower end of the device 100. In Step 3, the main strap end 28 of the main strap portion 26 is folded downward over the upper end of the device 100 and third hook portion 44 is secured to second loop portion 52. In Step 4, the portion of the device wrap portion 24 extending from the right side of the device 100 is folded around the right side of the device 100 and first hook portion 40 is secured to the portion of second loop portion 52 proximate to the top surface of the device 100 such that first loop portion 50 is exposed. In Step 5, the portion of the device wrap portion 24 extending from the left side of the device 100 is folded around the left side of the device 100 and second hook portion 42 is secured to first loop portion 50. In Step 6, the tail strap 14 is then folded around the lower end of the device 100, leaving a portion of fourth hook portion 46 exposed. In Step 7, main strap portion 26 is pulled upward such that third hook portion 44 releases from second loop portion 52 and tail strap 14 is wrapped upward such that fourth hook portion 46 is secured to second loop portion 52 and such that third loop portion 54 is exposed. In Step 8, main strap portion 26 is folded back downward over the upper portion of the device 100 and third hook portion 44 is secured to third loop portion 54. When assembled in this manner, a belt loop is formed between the tail strap 14 and the device wrap portions 24 secured proximate to the bottom surface of the device 100 and the main strap portion 26 forms a cover that allows the device 100 to be secured within the carrying case 10.

Figure 4A:
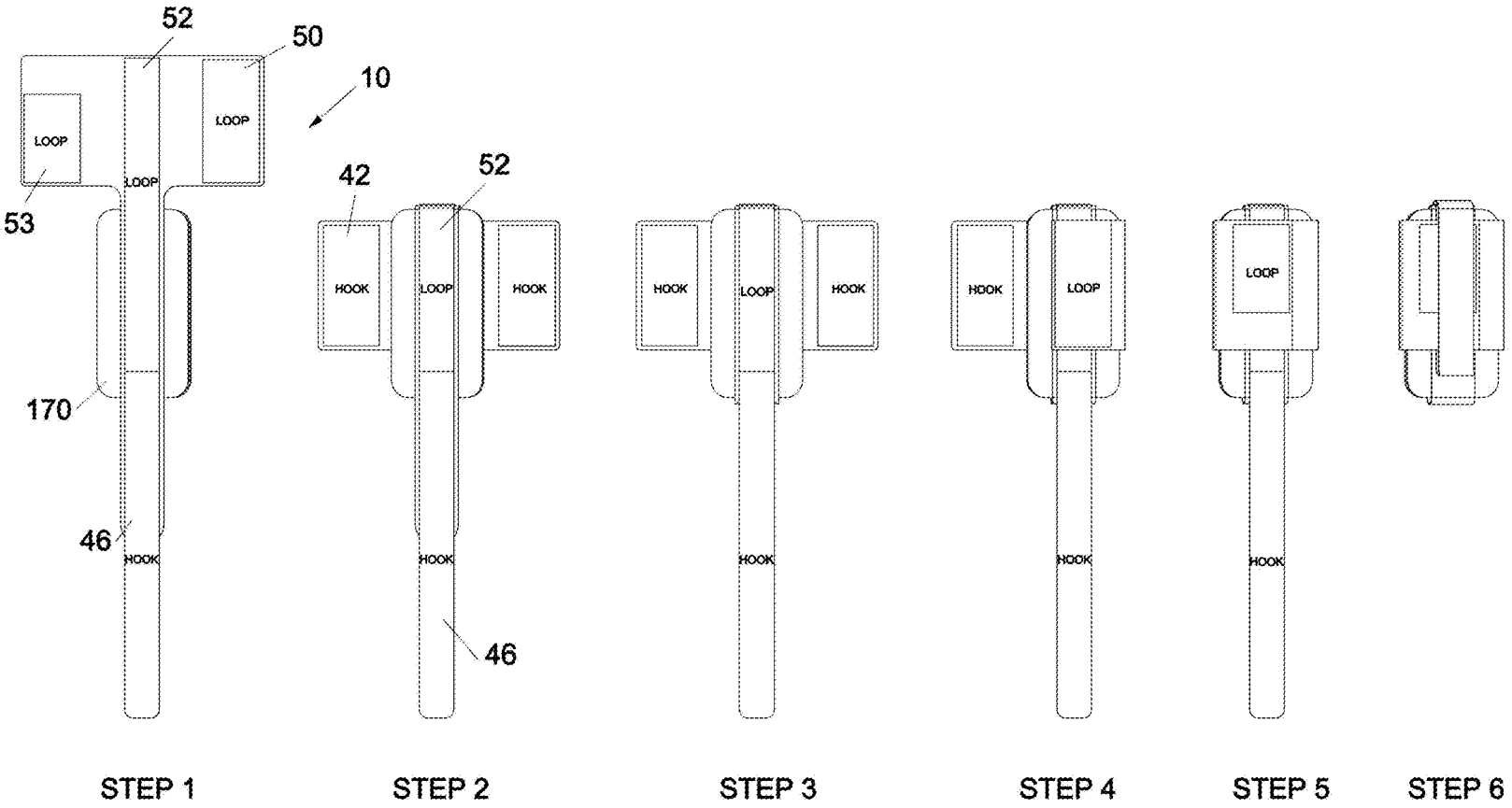
FIG. 4A is a series of top views of the carrying case demonstrating the steps of the method of securing a smartphone device within the carrying case in which the case forms a belt loop.
Figure 4B:
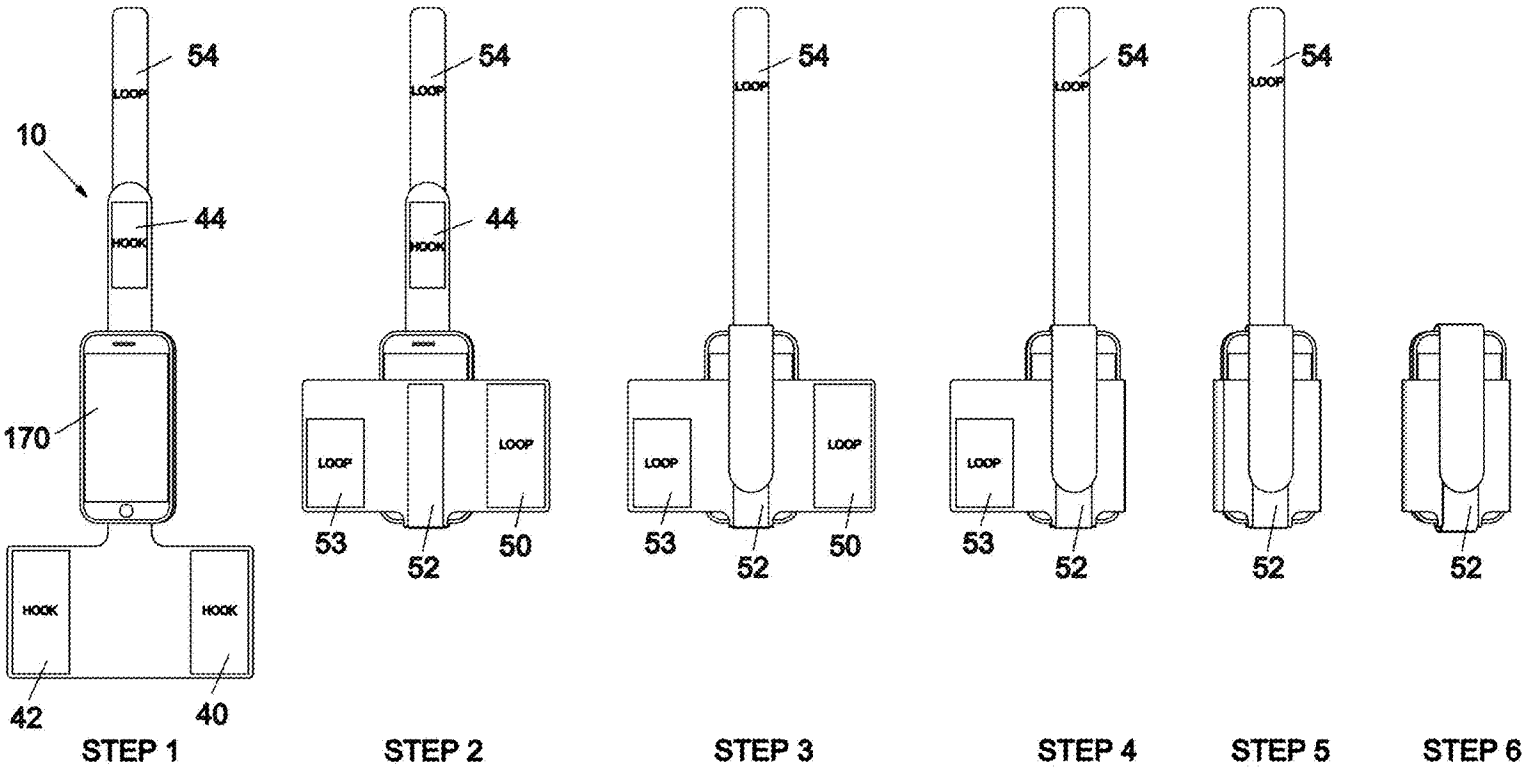
FIG. 4B is a series of bottom views of the carrying case demonstrating the steps of the method of securing a smartphone device within the carrying case in which the case forms a belt loop.

Referring now to FIGS. 4A and 4B, an embodiment of the method of securing the carrying case 10 to a smartphone device 170 is shown. In this method, each of Steps 1-Step 6 of the method of FIGS. 3A and 3B are performed but Step 7 and Step 8 are omitted.

In another embodiment of the method, the carrying case 10 is attached to a belt, or other thing, not by the belt loop but, rather, by folding and securing device wrap portion 24 around the belt. This method includes all of the steps of the preferred method but includes the additional steps of unsecuring the second hook portion 42 from the first loop portion 50, unsecuring the first hook portion 40 from the second loop portion 52, wrapping the portion of the device wrap portion 24 extending from the right side of the device 100 around the belt and securing the first hook portion 40 to the portion of second loop portion 52 proximate to the bottom surface of the device 100, and wrapping the portion of the device wrap portion 24 extending from the left side of the device 100 around the belt and securing the second hook portion 42 to first loop portion 50.

Figure 5A:
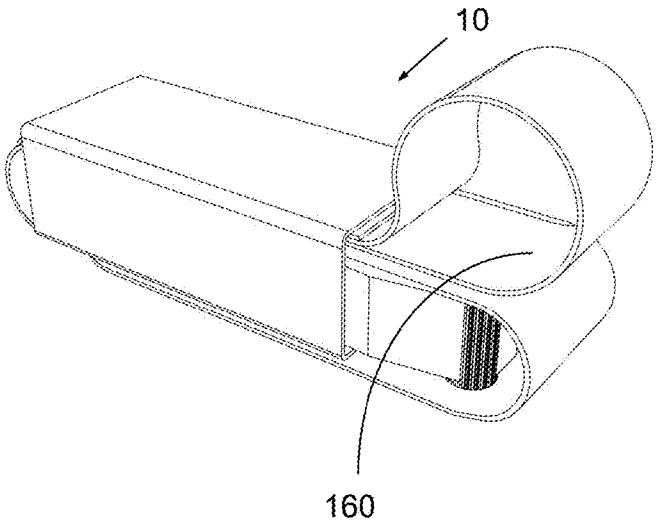
FIG. 5A is a side perspective view of a multi-tool device secured within the carrying case and the large loop gap formed by the tail strap.
Figure 5B:
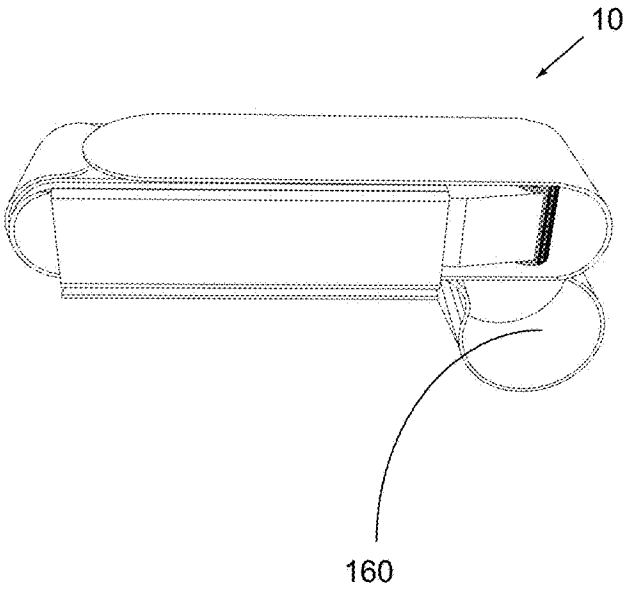
FIG. 5B is another side perspective view of a multi-tool device secured within the carrying case and the large loop gap formed by the tail strap.

As shown in FIGS. 5A and 5B, in still another embodiment of the method, the tail strap 14 is used to form a larger loop 160 that may be used to hang the case and device 100 from a thing, such as a bicycle handlebar, backpack D-ring, tent cross beam or the like. The steps of the method of securing the carrying case 10 to a device 100 such that a large loop is formed also begins with the main panel 12 laid flat with its top surface facing upward. First, a device 100 is placed upon the top surface of the main strap proximate to the device wrap portion 24. Second, the device wrap portion 24 is then folded upward such the bottom surface of the device wrap portion 24 is in contact with the device 100 and the portion of the main strap portion 26 proximate to the device wrap portion 24 is in contact with the lower end of the device 100. Third, the main strap end 28 of the main strap is then folded downward over the upper end of the device 100 and third hook portion 44 is secured to second loop portion 52. Fourth, the tail strap 14 is then folded in an opposite direction from the main strap end 28 and the fourth hook portion 46 is secured to the second loop portion 52 such that the tail strap 14 forms a loop of a desired size. Fifth, the portion of the device wrap portion 24 extending from the right side of the device 100 is then folded around the right side of the device 100 and first hook portion 40 is secured to the third loop. Sixth, the portion of the device wrap portion 24 extending from the left side of the device 100 is then folded around the left side of the device 100 and second hook portion 42 is secured to first loop portion 50. When assembled in this manner, a loop is formed by the tail strap 14 and the main strap forms a cover that allows the device 100 to be secured within the carrying case 10.

Figure 6A:
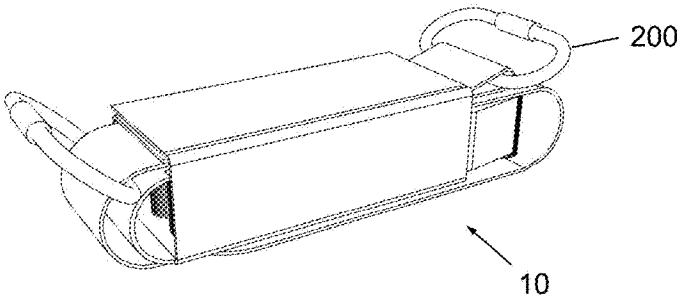
FIG. 6A is a side perspective view of one embodiment of the kit in which a multi-tool device secured within the carrying case and a pair of quick link type chain connectors are secured by the tail strap.
Figure 6B:
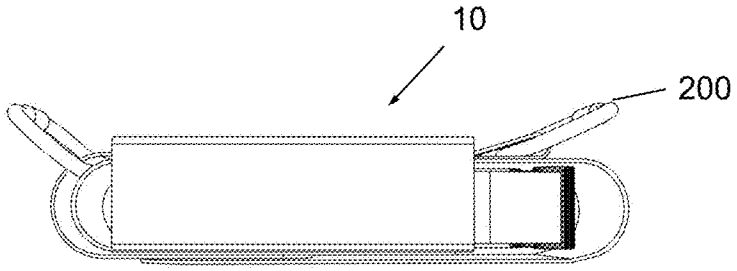
FIG. 6B is another side perspective view of one embodiment of the kit in which a multi-tool device secured within the carrying case and a pair of quick link type chain connectors are secured by the tail strap.

As shown in FIGS. 6A-6C, the kit of the present invention includes the carrying case 10 and at least one connector 200, such as a quick link chain connector, a carabineer, D-ring, or the like. In these embodiments, the connector 200 includes an opening that is sized to allow the tail strap 14 to pass therethrough. In some embodiments of the kit, two or more of the same type of connector 200 are provided. In still others, at least one of a variety of types of connectors are provided.

Although the present invention has been described in considerable detail with reference to certain preferred versions thereof, other versions would be readily apparent to those of ordinary skill in the art. Therefore, the spirit and scope of the description of the claimed invention should not be limited to the description of the preferred versions contained herein.

What is claimed is:

1. A carrying case for carrying a device having a width and a length, said carrying case comprising:

a main panel having a top surface and a bottom surface, said main panel comprising:

a substantially rectangular device wrap portion having a width defined by a pair of sides and sized to wrap around the width of the device, and a length defined by a pair of ends and sized to cover at least a substantial portion of the length of the device; and a main strap portion having a main strap length and a main strap width, wherein said main strap portion extends from said device wrap portion and is positioned such that a midpoint of said main strap width is substantially coincident with a midpoint of said width of said device wrap portion, wherein said main strap width is a fraction of said width of the device wrap portion, and wherein said main strap length is at least one and a half times the length of the device; and a tail strap having a tail strap top surface, a tail strap bottom surface, a tail strap width defined by a pair of tail strap sides, and a tail strap length defined by a tail strap connection end and a tail strap free end, wherein said tail strap connection end is connected to and extends from said top surface of said main strap portion of said main panel;

a first hook portion of a hook and loop fastener and second hook portion of a hook and loop fastener, wherein each of said first hook portion and said second hook portion are disposed upon the bottom surface of the device wrap portion of the main panel proximate to opposite sides of said device wrap portion;

a third hook portion of a hook and loop fastener disposed upon said bottom surface of the main strap portion proximate to the end of said main strap opposite the device wrap portion;

a fourth hook portion of a hook and loop fastener disposed upon substantially an entire top surface of the tail strap;

a first loop portion of a hook and loop fastener disposed upon said top surface of the device wrap portion proximate to one side of said device wrap portion;

a second loop portion of a hook and loop fastener disposed upon said top surface of said main panel proximate to said midpoint of the device wrap portion and extending along substantially an entire length of the bottom surface of said device wrap portion and along said main strap to said connection end of said tail strap; and a third loop portion of a hook and loop fastener disposed upon substantially an entire bottom surface of the tail strap.

2. The carrying case as claimed in claim 1 wherein said main panel is manufactured from a substantially thin flexible material.

3. The carrying case as claimed in claim 2 wherein said substantially thin flexible material is a nylon material having a thickness of between 0.020 inches and 0.040 inches.

4. The carrying case as claimed in claim 2 wherein said substantially thin flexible material is a nylon material having a thickness of 0.020 inches and wherein at least a portion of said sides of said main panel and said ends of said main panel comprise folded edges.

5. The carrying case as claimed in claim 1 wherein said tail strap connection end is connected to and extends from said bottom surface of said main strap portion of said main panel at a location along the length of said main strap a distance of between four inches and six and one half inches.

6. The carrying case as claimed in claim 4 wherein said width of said device wrap portion is between five inches and twelve inches.

7. The carrying case as claimed in claim 4 wherein said length of said device wrap portion is between two and one half inches and six inches.

8. The carrying case as claimed in claim 1 wherein said tail strap width is smaller than said main strap width.

9. The carrying case as claimed in claim 1 wherein said tail strap length is between one and a half times and two and a half times the length of the device.

10. The carrying case as claimed in claim 1 wherein said first hook portion and said second hook portion each extend substantially along an entire length of said top surface of said device wrap portion.

11. The carrying case as claimed in claim 1 wherein said first loop portion extends substantially along an entire length of said top surface of the device wrap portion.

12. The carrying case as claimed in claim 1 further comprising a retaining loop portion of hook and loop fastener disposed on said bottom surface of said device wrap portion at a location proximate to said side of said device wrap portion opposite from said side of said device wrap portion along which said first loop portion is proximate.

13. The carrying case as claimed in claim 1, wherein said tail strap is manufactured from a double sided hook and loop fastener material.

14. The carrying case as claimed in claim 1 wherein said tail strap is manufactured from a substantially thin flexible material and wherein said fourth hook portion and said third loop portion as separate sheets of single sided hook and loop fastener that are attached to said substantially thin flexible material.

15. A method for assembling a carrying case for carrying a device having a width and a length, said carrying case comprising:

a main panel having a top surface and a bottom surface, said main panel comprising:

a substantially rectangular device wrap portion having a width defined by a pair of sides and sized to wrap around the width of the device, and a length defined by a pair of ends and sized to cover at least a substantial portion of the length of the device; and a main strap portion having a main strap length and a main strap width, wherein said main strap portion extends from said device wrap portion and is positioned such that a midpoint of said main strap width is substantially coincident with a midpoint of said width of said device wrap portion, wherein said main strap width is a fraction of said width of the device wrap portion, and wherein said main strap length is at least one and a half time the length of the device; and a tail strap having a tail strap top surface, a tail strap bottom surface, a tail strap width defined by a pair of tail strap sides, and a tail strap length defined by a tail strap connection end and a tail strap free end, wherein said tail strap connection end is connected to and extends from said bottom surface of said main strap portion of said main panel, wherein said tail strap a tail strap top surface and a tail strap bottom surface;

a first hook portion of a hook and loop fastener and second hook portion of a hook and loop fastener, wherein each of said first hook portion and said second hook portion are disposed upon the top surface of the device wrap portion of the main panel proximate to opposite sides of said device wrap portion;

a third hook portion of a hook and loop fastener disposed upon a portion of said main strap proximate to the end of said main strap opposite the device wrap portion;

a fourth hook portion of a hook and loop fastener disposed upon substantially an entire bottom surface of the tail strap;

a first loop portion of a hook and loop fastener disposed upon said bottom surface of the device wrap portion proximate to one side of said device wrap portion;

a second loop portion of a hook and loop fastener disposed upon said bottom surface of said main panel proximate to said midpoint of the device wrap portion and extending along substantially an entire length of the bottom surface of said device wrap portion and along said main strap to said connection end of said tail strap; and a third loop portion of a hook and loop fastener disposed upon substantially an entire bottom surface of the tail strap; said method comprising the steps of:

placing said device upon the bottom surface of the main strap proximate to the device wrap portion;

folding the device wrap portion upward such the bottom surface of the device wrap portion is in contact with the device and the portion of the main strap portion proximate to the device wrap portion is in contact with the lower end of the device;

folding the main strap end of the main strap is then folded downward over the upper end of the device and third hook portion is secured to second loop portion;

folding the portion of the device wrap portion extending from the right side of the device around the right side of the device and securing the hook portion to the portion of second loop portion proximate to the bottom surface of the device such that the first loop portion is exposed;

folding the portion of the device wrap portion extending from the left side of the device around the left side of the device and securing the second hook portion to first loop portion;

folding the tail strap around the lower end of the device such that a portion of fourth hook portion remains exposed;

pulling the main strap upward such that third hook portion releases from second loop portion and tail strap is wrapped upward such that fourth hook portion is secured to second loop portion and such that third loop portion is exposed;

folding the main strap downward over the upper portion of the device and third hook portion is secured to third loop portion;

wherein a loop is formed by a gap between the tail strap and the device wrap portions secured proximate to the bottom surface of the device, and wherein main strap forms a cover that allows the device to be secured within the carrying case.

16. The method as claimed in claim 15 further comprising the steps of:

unsecuring the second hook portion from the first loop portion;

unsecuring the first hook portion from the second loop portion;

wrapping the portion of the device wrap portion extending from the right side of the device around the belt and securing the first hook portion to the portion of second loop portion proximate to the bottom surface of the device; and wrapping the portion of the device wrap portion extending from the left side of the device around the belt and securing the second hook portion to first loop portion.

17. A carrying case kit comprising:

a carrying case for carrying a device having a width and a length, said carrying case comprising:

a main panel having a top surface and a bottom surface, said main panel comprising:

a substantially rectangular device wrap portion having a width defined by a pair of sides and sized to wrap around the width of the device, and a length defined by a pair of ends and sized to cover at least a substantial portion of the length of the device; and a main strap portion having a main strap length and a main strap width, wherein said main strap portion extends from said device wrap portion and is positioned such that a midpoint of said main strap width is substantially coincident with a midpoint of said width of said device wrap portion, wherein said main strap width is a fraction of said width of the device wrap portion, and wherein said main strap length is at least one and a half times the length of the device; and a tail strap having a tail strap top surface, a tail strap bottom surface, a tail strap width defined by a pair of tail strap sides, and a tail strap length defined by a tail strap connection end and a tail strap free end, wherein said tail strap connection end is connected to and extends from said bottom surface of said main strap portion of said main panel, wherein said tail strap a tail strap top surface and a tail strap bottom surface;

a first hook portion of a hook and loop fastener and second hook portion of a hook and loop fastener, wherein each of said first hook portion and said second hook portion are disposed upon the top surface of the device wrap portion of the main panel proximate to opposite sides of said device wrap portion;

a third hook portion of a hook and loop fastener disposed upon a portion of said main strap proximate to the end of said main strap opposite the device wrap portion;

a fourth hook portion of a hook and loop fastener disposed upon substantially an entire bottom surface of the tail strap;

a first loop portion of a hook and loop fastener disposed upon said bottom surface of the device wrap portion proximate to one side of said device wrap portion;

a second loop portion of a hook and loop fastener disposed upon said bottom surface of said main panel proximate to said midpoint of the device wrap portion and extending along substantially an entire length of the bottom surface of said device wrap portion and along said main strap to said connection end of said tail strap; and a third loop portion of a hook and loop fastener disposed upon substantially an entire bottom surface of the tail strap; and at least one of a connector and a device.

18. The kit as claimed in claim 17 wherein said connector is selected from a group consisting of a quick link chain connector, a carabineer, and a D-ring.

19. The kit as claimed in claim 17 wherein said device is selected from a group consisting of a knife, a flashlight, and a multi-tool.

* * * * *